US006129240A

United States Patent [19]

Morand

[11] Patent Number: 6,129,240

[45] Date of Patent: Oct. 10, 2000

[54] DISPENSER NOZZLE AND METHOD FOR DISPENSING INDIVIDUAL SHEETS FROM THE CENTER OF A CORELESS ROLL PRODUCT

[75] Inventor: Michel Morand, Montreal, Canada

[73] Assignee: Perrin Manufacturing Company, City of Industry, Calif.

[21] Appl. No.: 09/198,904

[22] Filed: Nov. 24, 1998

[51] Int. Cl.[7] ..... B65D 83/00

[52] U.S. Cl. ..... 221/63; 206/409

[58] Field of Search ..... 221/33, 63, 61; 242/593, 615.3; 206/409

[56] References Cited

U.S. PATENT DOCUMENTS

| | | | |
|---|---|---|---|
| 4,651,895 | 3/1987 | Niske et al. | 221/63 |
| 4,905,868 | 3/1990 | Beane et al. . | |
| 5,141,171 | 8/1992 | Yang . | |
| 5,246,137 | 9/1993 | Schutz et al. . | |
| 5,310,083 | 5/1994 | Rizzuto . | |
| 5,346,064 | 9/1994 | Rizzuto | 206/409 |
| 5,715,971 | 2/1998 | Morand . | |
| 5,749,492 | 5/1998 | Petterson . | |
| 5,765,718 | 6/1998 | Grasso et al. . | |
| 5,868,346 | 2/1999 | Cobos | 242/593 |

*Primary Examiner*—H. Grant Skaggs
*Attorney, Agent, or Firm*—Thomas R. Lampe

[57] ABSTRACT

A center-pull dispenser nozzle includes a nozzle segment with an inner wall having a truncated cone-like configuration. A restrictor ring restricts an outlet opening of the nozzle segment. The restrictor ring engages a web passing through the nozzle and redirects and resists movement of the web at the location of the outlet opening to improve sheet separation and provide a less wrinkled dispensed sheet product.

3 Claims, 3 Drawing Sheets

DISPENSER NOZZLE AND METHOD FOR DISPENSING INDIVIDUAL SHEETS FROM THE CENTER OF A CORELESS ROLL PRODUCT

TECHNICAL FIELD

This invention relates to the dispensing of sheet material, and more particularly to an apparatus and a method for dispensing individual sheets, such as paper towels, from the center of a coreless roll comprised of a plurality of the sheets.

BACKGROUND OF THE INVENTION

A number of center-pull dispensers exist in the prior art for dispensing paper toweling and the like from the center of a coreless roll through a nozzle having an opening through which the sheet material passes. Assuming that the individual sheets of toweling or the like are connected by perforated lines, as is common, the nozzle or other element defining an opening through which the sheet material is passed will resist pulling of the sheet material by the user, thus breaking an individual sheet from the remaining web along the perforated lines interconnecting same.

It is quite common to utilize center-pull nozzles which have a cone-like or funnel-shaped configuration. For example, U.S. Pat. No. 4,905,868, issued Mar. 6, 1990, discloses a paper towel dispenser employing a conical funnel having an exit hole smaller than the entrance hole thereof which provides an exit for paper towels being dispensed. The entrance opening and exit opening of the conical funnel are dimensioned such that a first paper towel will separate from a following paper towel along the perforation boundary therebetween when a leading portion of the following paper towel exits from the exit opening of the funnel.

U.S. Pat. No. 5,310,083, issued May 10, 1994, discloses a dispenser nozzle having interconnecting portions, one of which has a truncated cone-like configuration and the other of which has a cylindrical configuration. The portion of the nozzle having the cylindrical configuration is located at the exit opening of the nozzle to provide increased contact area for sheets passing therethrough to reduce wear and extend the life of the nozzle.

Other patents disclosing center-pull nozzles believed to be representative of the current state of the art in the field are as follows: U.S. Pat. No. 5,715,971, issued Feb. 10, 1998, U.S. Pat. No. 5,141,171, issued Aug. 25, 1992, U.S. Pat. No. 5,246,137, issued Sep. 21, 1993, U.S. Pat. No. 5,765,718, issued Jun. 16, 1998, and U.S. Pat. No. 5,749,492, issued May 12, 1998. The patents just noted relate to various approaches for dispensing towels and other sheets from a supply thereof by pulling the sheets through a restricted opening to detach one sheet from another.

Because of the relatively small exit openings employed and required to provide the desired sheet separation, known center-pull dispenser nozzles typically cause considerable wrinkling and crumpling of the sheet material as it exits, resulting in an unsightly sheet being presented to the consumer. Furthermore, some prior art nozzle constructions are not always reliable, it not being uncommon that paper toweling and the like is not always torn along the perforation lines of the web material.

In prior art center pull nozzle constructions the size of the outlet opening must be very precise and accurate. Opening size in such nozzle constructions must be precisely matched to the physical characteristics of the paper or other sheet material passing therethrough, such physical characteristics including thickness, perforation spacing, paper basis weight, etc. If the outlet size varies, for example due to wear during dispenser use, the paper or other sheet material will not dispense properly.

DISCLOSURE OF INVENTION

The present invention relates to a dispenser nozzle and a method which provide for the ready dispensing of individual sheets from the center of a coreless roll product in a manner which wrinkles the sheet being dispensed to a considerably lesser degree than conventional prior art center-pull nozzle systems. Furthermore, the construction and operation of the dispenser nozzle disclosed and claimed herein promotes tearing of the toweling or other sheet material along perforation lines dividing the material into individual sheets. Also, nozzle outlet opening size is not as critical to the proper operation of the center pull nozzle as it is in prior art constructions.

The dispenser nozzle is for dispensing individual sheets from the center of a coreless roll product comprised of a plurality of sheets forming a wound roll having a lead end projecting outwardly from the roll center.

The dispenser nozzle includes a nozzle segment defining an inlet opening for receiving the lead end and having a nozzle segment inner wall surface defining a passageway leading from the inlet opening to an outlet opening defined by the distal end of the nozzle segment and spaced from the inlet opening. The nozzle segment inner wall surface has a truncated cone-like configuration and the cross-section of the passageway decreases in size in the direction of the distal end.

A restrictor element is attached to the nozzle segment at the distal end thereof and projects inwardly from the nozzle segment inner wall surface into the outlet opening to restrict the outlet opening. The restrictor element is for engaging the web as the web exits the passageway for redirecting and resisting movement of the web at the location of the outlet opening.

The method of the present invention includes the step of positioning a coreless roll product adjacent to an inlet of a nozzle segment having a nozzle segment inner wall surface defining a passageway leading from the inlet to an outlet of a nozzle segment, the passageway becoming increasingly restricted in the direction of the outlet.

The lead end of the web of a coreless roll product is passed through the inlet of the nozzle segment, through the passageway, and subsequently through the outlet of the nozzle segment.

A pulling force is exerted on the lead end of the web to cause the web to move through and exit the nozzle segment through the outlet of the nozzle segment in a predetermined direction.

The method also includes the step of positioning a restrictor element at the outlet of the nozzle segment to restrict the outlet. Prior to passage of the web through the outlet of the nozzle segment, the web is brought into engagement with the restrictor element. The restrictor element is employed to displace the web in a direction generally orthogonal to the predetermined direction to redirect and restrict movement of the web.

Other features, advantages, and objects of the present invention will become apparent with reference to the following description and accompanying drawings.

MODES FOR CARRYING OUT THE INVENTION

Figure 1:
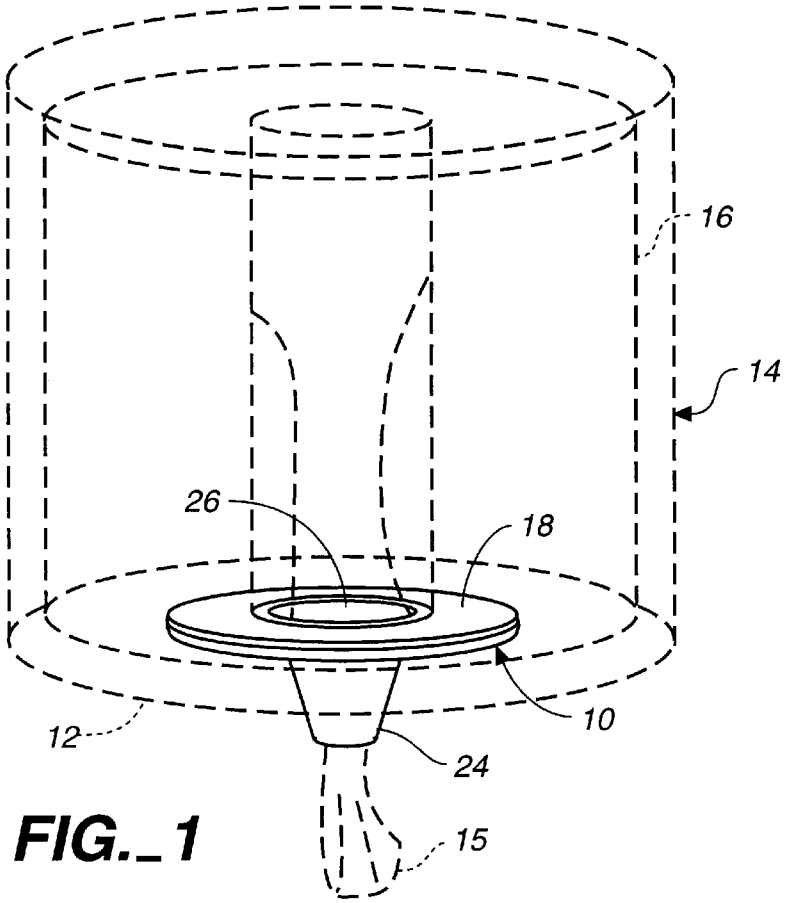
FIG. 1 is a perspective view illustrating the position assumed by a dispenser nozzle constructed in accordance with the teachings of the present invention when the nozzle is positioned on a support of a center pull dispenser housing and under a coreless roll product being dispensed through the nozzle.
Figure 4:
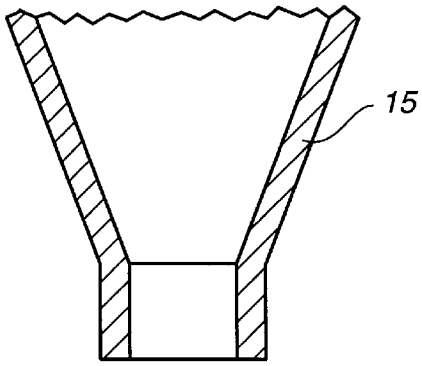
FIG. 4 (PRIOR ART)
FIG. 4 is a view similar to FIG. 2 and illustrating yet another form of prior art nozzle construction.
Figure 5:
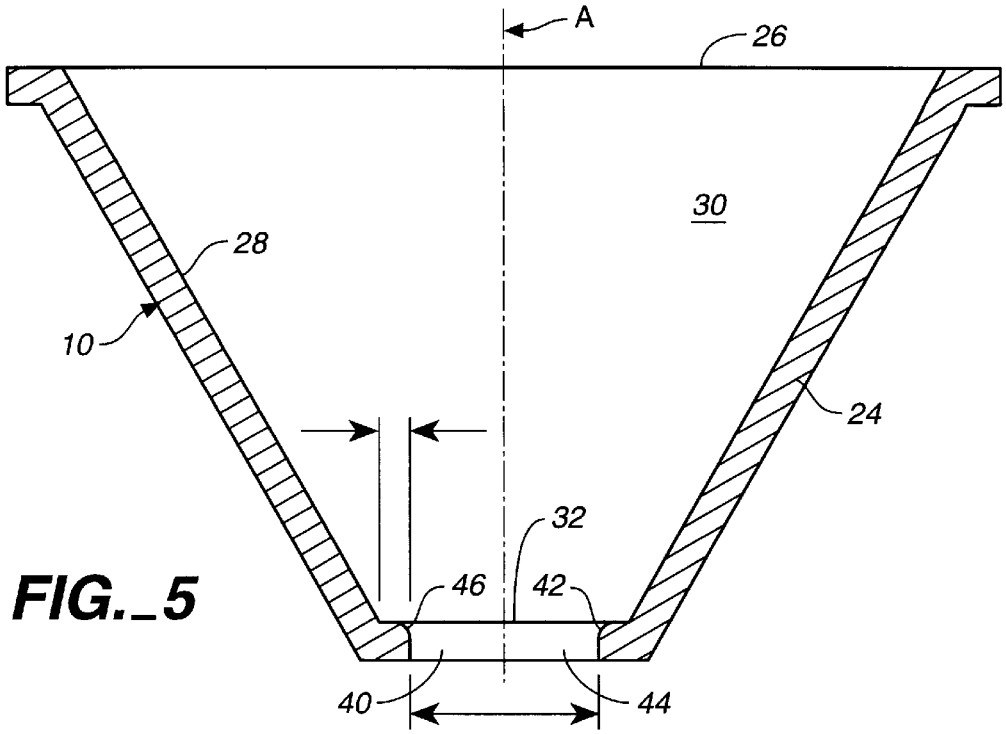
FIG. 5 is an enlarged, cross-sectional, elevational view illustrating a nozzle constructed in accordance with the teachings of the present invention.
Figure 6:
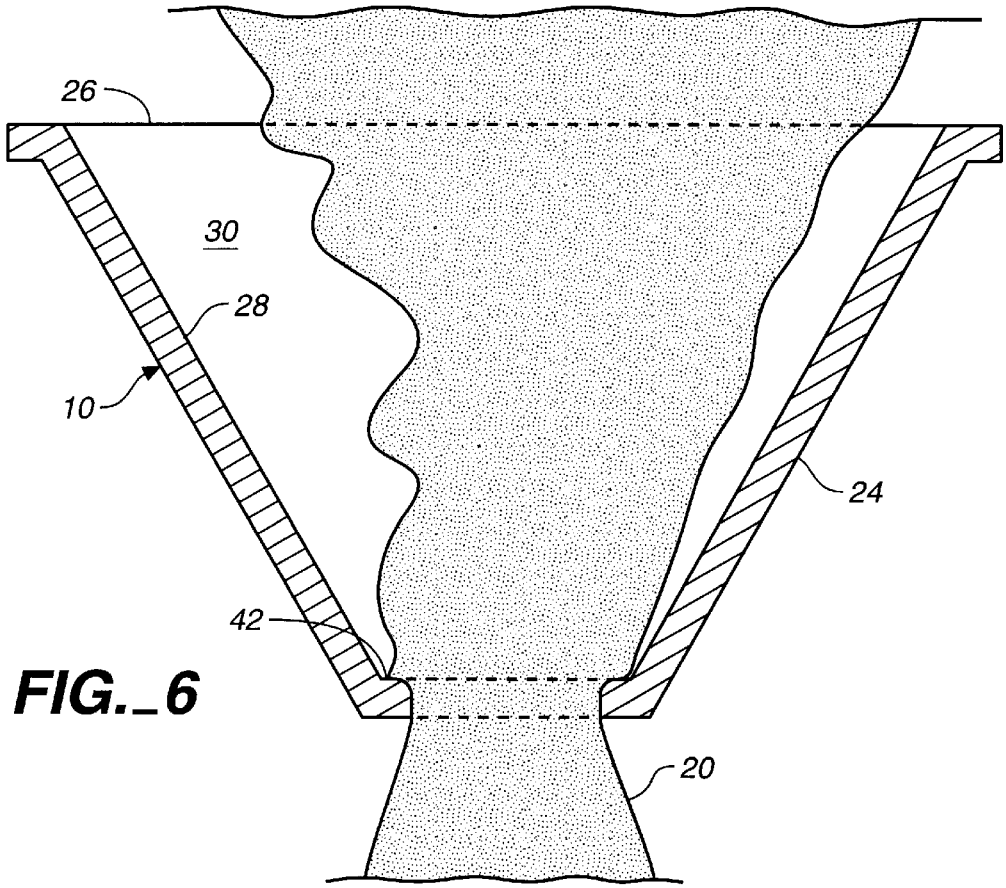
FIG. 6 is a view similar to FIG. 5 but illustrating in a paper towel being pulled through the nozzle.

Referring now to FIGS. 1–6 and more particularly FIGS. 1, 5 and 6, a dispenser nozzle constructed in accordance with the teachings of the present invention is indicated by reference numeral 10.

Nozzle 10 may be formed of any suitable material but preferably is of unitary, molded plastic construction. The nozzle 10 when in use is positioned on a support, for example the bottom wall 12 of a dispenser 14 (FIG. 1). Positioned within the dispenser and supported by the bottom wall is a coreless roll product 16 comprising a plurality of paper towels forming a wound web and separated by perforation lines (not shown) in a conventional manner. The roll may be supported either directly on the bottom wall 12 or on the nozzle 10 itself, the latter in turn being supported on the bottom wall. This latter arrangement is shown in FIG. 1 wherein the nozzle 10 has a flange 18 which is located on the support 12 and under the roll. A cone-like segment or section of the dispenser nozzle, described in detail below, projects downwardly through a hole formed in the support 12 and accommodates therein a lead end 20 projecting from the center of coreless roll 16.

Nozzle 10 includes a nozzle segment 24 defining an inlet opening 26 for receiving the lead end 20 of the toweling. Nozzle segment 24 also includes an inner wall surface 28 defining a passageway 30 leading from the inlet opening 26 to an outlet opening 32 defined by the distal end of the nozzle segment and spaced from the inlet opening. The nozzle segment inner wall surface has a truncated cone-like configuration and the cross-section of the passageway 30 decreases in size in the direction of the distal end of the nozzle segment. The inlet opening and the outlet opening are disposed along a common axis A (see FIG. 5) extending through the passageway.

Figure 2:
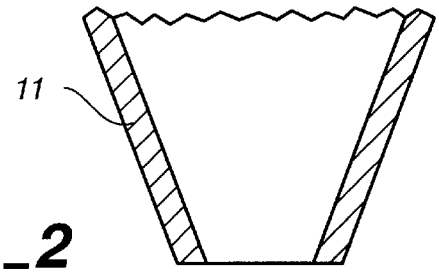
FIG. 2 (PRIOR ART)
FIG. 2 is an enlarged, cross-sectional view illustrating the lower portion of one type of center-pull nozzle known in the prior art.
Figure 3:
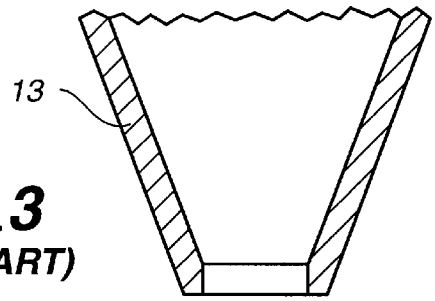
FIG. 3 (PRIOR ART)
FIG. 3 is a view similar to FIG. 2 but illustrating another form of prior art nozzle configuration.

In contrast with the representative center pull dispenser nozzles 11, 13 and 15 shown in FIGS. 2, 3 and 4, respectively, the dispenser nozzle 10 also includes a restrictor element attached to the nozzle segment 24 at the distal end thereof projecting inwardly from the nozzle segment inner wall surface into the outlet opening 32 to restrict the outlet opening. As will be seen below, the restrictor element engages toweling exiting the passageway 30 for the purposes of redirecting and resisting movement of the toweling at the location of the outlet opening.

More particularly, the restrictor element is in the form of a ring 40 which extends completely about the nozzle segment inner wall surface. The ring-shaped restrictor element has a flat web engagement surface 42. The web engagement surface is disposed in a plane orthogonal to the direction of movement of the toweling through outlet opening 32 corresponding to axis A. Thus, the inlet opening and the outlet opening are disposed along a common axis extending through the passageway in the predetermined direction of web movement.

Ring-shaped restrictor element 40 has an annular web contact surface 44 orthogonal to the web engagement surface 42. A curved surface 46 interconnects the annular web contact surface 44 and the flat web engagement surface 42.

In operation, the coreless paper towel roll is positioned adjacent to the inlet of the nozzle segment as shown in FIG. 1. The lead end 22 is then passed through the inlet opening 26, through the passageway 30, and subsequently through the outlet opening 32 so that it protrudes from the dispenser nozzle.

The consumer then exerts a pulling force on the lead end of the web to cause the web to move through and exit the nozzle segment 24 through the outlet opening in a direction corresponding to axis A. Prior to passage of the web through the outlet opening, the toweling or other web material is brought into engagement with the restrictor ring 40. This is shown in FIG. 6. The restrictor element 40 displaces the web in a direction generally orthogonal to the predetermined direction of web movement through the outlet opening to redirect and restrict movement of the web. More particularly, the restrictor element or ring 40 extends completely about the toweling and the toweling is displaced radially inwardly prior to exit of the toweling through the outlet opening of the nozzle segment.

This action promotes tearing of the toweling along the perforation lines (not shown) formed therein to provide for improved dispenser performance and a more desirable and neater final sheet product. This arrangement allows the size of outlet opening 32 to be substantially larger than outlet openings employed in known prior art center pull nozzles to achieve proper sheet separation. There is less wrinkling and crumpling of the product as it exits the dispenser nozzle of the present invention, further improving the appearance of the dispensed sheets.

Figure 7:
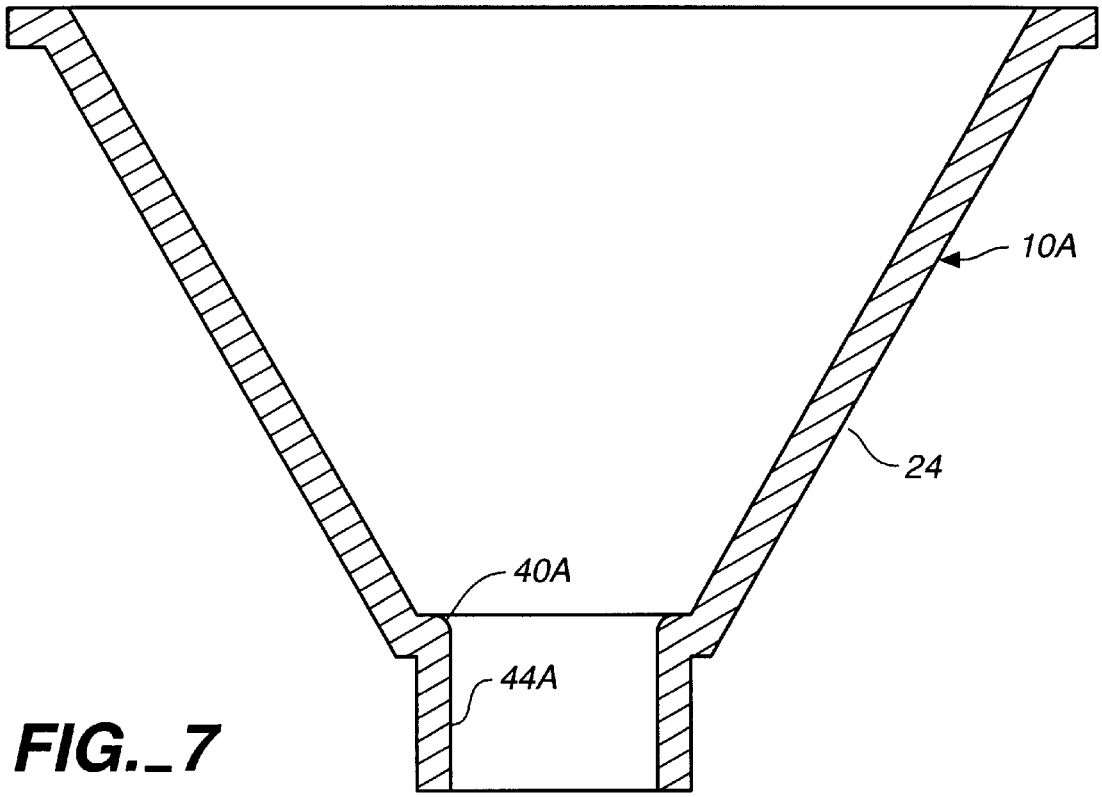
FIG. 7 is a view similar to FIG. 5 showing an alternate embodiment of the invention.

FIG. 7 illustrates an alternate embodiment 10A of the invention wherein ring 40A is longer than ring 40 of the previously described embodiment. That is, the annular web contact surface 44A is elongated relative to annular web contact surface 44 described above.

What is claimed is:

1. A dispenser nozzle for dispensing individual sheets from the center of a coreless roll product comprised of a plurality of sheets forming a wound roll having a lead end projecting outwardly from the roll center, said dispenser nozzle comprising, in combination:

a nozzle segment defining an inlet opening for receiving said lead end and having a nozzle segment inner wall surface defining a passageway leading from said inlet opening to an outlet opening defined by a distal end of said nozzle segment and spaced from said inlet opening, said nozzle segment inner wall surface having a truncated cone-like configuration and the cross-section of said passageway decreasing in size in the direction of said distal end; and a restrictor element attached to said nozzle segment at the distal end thereof projecting inwardly from said nozzle segment inner wall surface into said outlet opening to restrict said outlet opening, said restrictor element for engaging said web as said web exits said passageway for redirecting and resisting movement of the web at the location of said outlet opening, said restrictor element comprising a ring-shaped restrictor element protecting inwardly from said nozzle segment inner wall surface and having a substantially flat web engagement surface extending inwardly from said nozzle segment inner wall surface, said web movable along a predetermined direction of web movement when said web passes through said outlet opening and said substantially flat web engagement surface disposed in a plane substantially orthogonal to said predetermined direction and facing in the direction of said inlet opening for engaging said web during web movement to exert drag forces on said web and impede said web movement prior to passage of said web through said outlet opening, said inlet opening and said outlet opening being disposed along a common axis extending through said passageway along said predetermined direction of web movement, said ring-shaped restrictor element having an annular web contact surface disposed substantially orthogonal to said substantially flat web engagement surface, and said ring-shaped restrictor element additionally having an annular curved surface interconnecting said annular web contact surface and said substantially flat web engagement surface, said annular curved surface being engaged by said web when said web moves along said predetermined direction of web movement to facilitate movement of said web between said substantially flat web engagement surface and said annular web contact surface.

2. The dispenser nozzle according to claim 1 wherein said nozzle segment and said restrictor element are of integral construction.

3. The dispenser nozzle according to claim 1 wherein said annular web contact surface is elongated.

* * * * *